US011345872B2

(12) United States Patent
Gao

(10) Patent No.: US 11,345,872 B2
(45) Date of Patent: May 31, 2022

(54) SULFUR-FREE, ASHLESS, LOW PHOSPHORUS LUBRICANT COMPOSITIONS WITH IMPROVED OXIDATION STABILITY

(71) Applicant: ExxonMobil Technology and Engineering Company, Annandale, NJ (US)

(72) Inventor: Zhisheng Gao, Flemington, NJ (US)

(73) Assignee: ExxonMobil Technology and Engineering Company, Annandale, NJ (US)

( * ) Notice: Subject to any disclaimer, the term of this patent is extended or adjusted under 35 U.S.C. 154(b) by 0 days.

(21) Appl. No.: 17/148,639

(22) Filed: Jan. 14, 2021

(65) Prior Publication Data

US 2021/0238493 A1 Aug. 5, 2021

Related U.S. Application Data

(60) Provisional application No. 62/967,624, filed on Jan. 30, 2020.

(51) Int. Cl.
*C10M 111/00* (2006.01)
*C10M 133/12* (2006.01)
(Continued)

(52) U.S. Cl.
CPC ..... *C10M 111/00* (2013.01); *C10M 133/12* (2013.01); *C10M 137/08* (2013.01);
(Continued)

(58) Field of Classification Search
CPC ..... C10N 2030/43; C10N 2030/45; C10N 2030/02; C10N 2030/04; C10N 2030/06;
(Continued)

(56) References Cited

U.S. PATENT DOCUMENTS 4,234,435 A 11/1980 Meinhardt et al.
5,602,086 A * 2/1997 Le ..... C10M 105/06 508/591
(Continued)

FOREIGN PATENT DOCUMENTS

EP 0496486 B1 7/1992
WO 2003064569 A1 8/2003
(Continued)

OTHER PUBLICATIONS

International Search Report and the Written Opinion of the International Searching Authority dated May 3, 2021.

*Primary Examiner* — Ellen M McAvoy
(74) *Attorney, Agent, or Firm* — Anthony G. Boone

(57) ABSTRACT

Sulfur-free, ashless, and low phosphorus-containing lubricant compositions for use as engine oil having improved oxidation stability. The lubricant composition can include about 60.0 mass % to about 99.8 mass % of an oil base stock, at least one ashless antiwear additive, at least one ashless detergent, and at least one antioxidant, based on a total mass of the lubricant composition. The oil base stock can include at least one polyalphaolefin and at least one alkyl naphthalene. The lubricant composition can contain less than about 0.05 mass % phosphorus, less than about 0.05 mass % sulfur, and less than about 0.05 mass % ash. The lubricant composition can be made by a process that includes combining the above-mentioned components to provide a lubricant composition.

24 Claims, 1 Drawing Sheet

(51) Int. Cl.

| | |
|---|---|
| ***C10M 137/08*** | (2006.01) |
| *C10N 30/00* | (2006.01) |
| *C10N 30/02* | (2006.01) |
| *C10N 30/04* | (2006.01) |
| *C10N 30/06* | (2006.01) |
| *C10N 40/25* | (2006.01) |

(52) U.S. Cl.
CPC ..... *C10M 2203/065* (2013.01); *C10M 2205/0285* (2013.01); *C10N 2030/02* (2013.01); *C10N 2030/04* (2013.01); *C10N 2030/06* (2013.01); *C10N 2030/43* (2020.05); *C10N 2030/45* (2020.05); *C10N 2040/25* (2013.01)

(58) Field of Classification Search
CPC ..... C10N 2040/25; C10M 2203/065; C10M 2205/0285; C10M 111/00; C10M 133/12; C10M 137/08
See application file for complete search history.

(56) References Cited

U.S. PATENT DOCUMENTS

| | | | | |
|---|---|---|---|---|
| 5,705,458 | A | 1/1998 | Roby et al. | |
| 6,180,575 | B1 * | 1/2001 | Nipe | C10M 141/10 508/227 |
| 7,704,930 | B2 | 4/2010 | Deckman et al. | |
| 9,040,470 | B2 | 5/2015 | Yagishita | |
| 9,234,152 | B2 * | 1/2016 | Martin | C10M 105/04 |
| 2006/0247140 | A1 * | 11/2006 | Cressey | C10M 133/14 508/551 |
| 2007/0203030 | A1 * | 8/2007 | Buck | C10M 163/00 508/569 |
| 2011/0237474 | A1 * | 9/2011 | Mazzamaro | C10M 141/08 508/364 |
| 2012/0322705 | A1 * | 12/2012 | Blain | C10M 169/04 508/430 |
| 2014/0187455 | A1 * | 7/2014 | Umehara | C10M 141/06 508/506 |
| 2018/0023018 | A1 * | 1/2018 | Han | C10M 111/04 508/482 |
| 2018/0201862 | A1 * | 7/2018 | Delbridge | C10M 133/06 |
| 2018/0230394 | A1 * | 8/2018 | Han | C10M 111/04 |
| 2019/0062668 | A1 * | 2/2019 | Gao | C10M 161/00 |
| 2019/0225911 | A1 * | 7/2019 | Sutton | C10M 141/10 |
| 2020/0199475 | A1 * | 6/2020 | Flores-Torres | C10M 107/02 |
| 2021/0087489 | A1 * | 3/2021 | Hoey | C10M 151/04 |

FOREIGN PATENT DOCUMENTS

| | | | |
|---|---|---|---|
| WO | 2004003117 | A1 | 1/2004 |
| WO | 2015114920 | A1 | 6/2015 |
| WO | 2015105704 | A1 | 7/2015 |
| WO | 2017034659 | A1 | 3/2017 |
| WO | 2019040576 | A1 | 2/2019 |

* cited by examiner

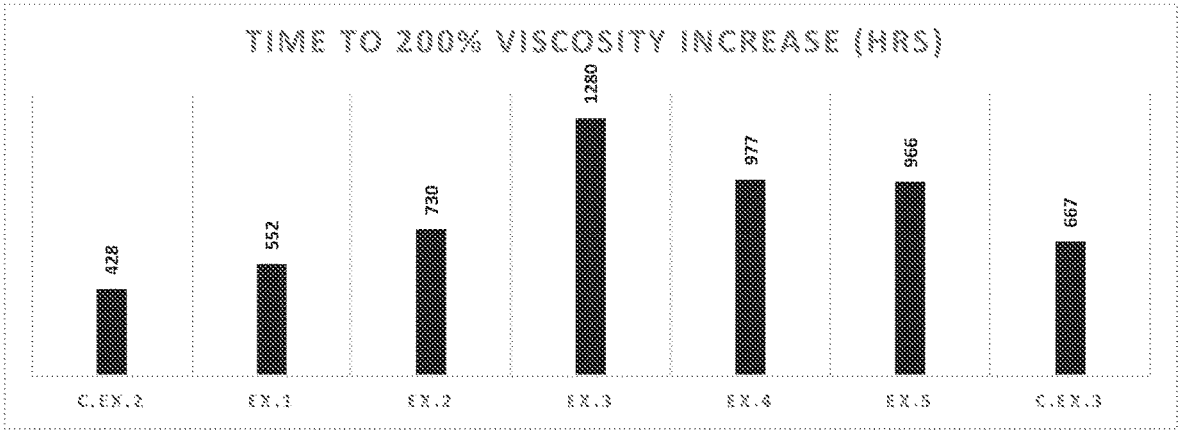
TIME TO 200% VISCOSITY INCREASE (HRS)
428
552
730
1280
977
966
667
C.EX.2
EX.1
EX.2
EX.3
EX.4
EX.5
C.EX.3

SULFUR-FREE, ASHLESS, LOW PHOSPHORUS LUBRICANT COMPOSITIONS WITH IMPROVED OXIDATION STABILITY

CROSS-REFERENCE TO RELATED APPLICATIONS

This application claims the benefit of priority from U.S. Provisional Application No. 62/967,624 filed Jan. 30, 2020, the entire contents of which are herein incorporated by reference in their entireties.

FIELD OF INVENTION

Embodiments of the present invention generally relate to lubricant compositions and processes for making same. More particularly, such embodiments relate to sulfur-free, ashless, and low phosphorus-containing engine lubricant compositions with improved oxidation stability and processes for making same.

BACKGROUND OF THE INVENTION

Conventional engine lubricants contain, among other things, an oil base stock, at least one antiwear additive to reduce friction between engine parts, at least one detergent to help maintain engine cleanliness, at least one dispersant to suspend contaminants in the oil, and at least one antioxidant. Phosphorus- and sulfur-containing compounds are commonly used as antiwear additives in engine lubricants. Examples of such antiwear additives are zinc dialkyldithiophosphates (ZDDP). Detergents that are typically used in engine lubricants include calcium sulfonates, calcium salicylates, and magnesium sulfonates. Over time such antiwear additives and detergents can lead to the formation of an ashy residue.

The sulfur, phosphorus, and ash present in conventional engine lubricants can adversely affect engine post-treatment devices and the catalyst used in such devices. For example, the presence of ash can impact particulate filters that are used in gasoline engines to meet emission requirements. The ash accumulated in the gasoline particular filter can increase engine back pressure, leading to poorer fuel economy.

Another problem associated with conventional engine lubricants is the oxidation of the lubricants at high temperatures. In recent years, engines are being downsized and operated with increased energy density to improve engine fuel efficiency. As a result, the temperatures of engine parts are higher today than in the past and can reach 200° C. or higher in some parts such as pistons and turbo chargers. Using antioxidants to protect engine lubricants from oxidation is usually insufficient at such high temperatures. Cooling of the engine is often required to maintain stability of the engine lubricant.

A need therefore exists for engine lubricants that exhibit improved oxidation stability at higher temperatures. Engine lubricants that contain less sulfur, phosphorus, and ash are also desired.

SUMMARY

Sulfur-free, ashless, and low phosphorus-containing lubricant compositions for use as engine oil having improved oxidation stability and processes for making same are provided. In one or more embodiments, the lubricant composition can include about 60.0 mass % to about 99.8 mass % of an oil base stock, based on a total mass of the lubricant composition. The oil base stock can include at least one polyalphaolefin and at least one alkyl naphthalene, at least one ashless antiwear additive, at least one ashless detergent, and at least one antioxidant. The lubricant composition can contain less than about 0.05 mass % phosphorus, less than about 0.05 mass % sulfur, and less than about 0.05 mass % ash.

In one or more embodiments, a process for making a lubricant composition can include combining about 60.0 mass % to about 99.8 mass % of an oil base stock, about 0.1 mass % to about 1.0 mass % of at least one ashless antiwear additive, about 0.5 mass % to about 2.0 mass % of at least one ashless detergent, and about 0.5 mass % to about 3.0 mass % of at least one antioxidant, to provide a lubricant composition. The oil base stock can include about 20.0 mass % to about 90.0 mass % of at least one polyalphaolefin and about 5.0 mass % to about 80.0 mass % of at least one alkyl naphthalene

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended FIGURE. It is to be noted, however, that the appended drawing illustrates only typical embodiments of this invention and is therefore not to be considered limiting of its scope, for the invention may admit to other equally effective embodiments.

The FIGURE is a bar graph depicting the time required to reach a 200% increase in viscosity for various lubricant compositions, according to one or more embodiments provided herein.

DETAILED DESCRIPTION

It is to be understood that the following disclosure describes several exemplary embodiments for implementing different features, structures, and/or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the FIGURE provided herein. This repetition is for the purpose of simplicity and clarity and does not in itself dictate a relationship between the various exemplary embodiments and/or configurations discussed in the FIGURE. Moreover, the exemplary embodiments presented below can be combined in any combination of ways, i.e., any element from one exemplary embodiment can be used in any other exemplary embodiment, without departing from the scope of the disclosure.

Additionally, certain terms are used throughout the following description and claims to refer to particular components. As one skilled in the art will appreciate, various entities can refer to the same component by different names, and as such, the naming convention for the elements described herein is not intended to limit the scope of the invention, unless otherwise specifically defined herein. Further, the naming convention used herein is not intended to distinguish between components that differ in name but not function.

In the following discussion and in the claims, the terms "including" and "comprising" are used in an open-ended fashion, and thus should be interpreted to mean "including, but not limited to." The phrase "consisting essentially of" means that the described/claimed composition does not include any other components that will materially alter its properties by any more than 5% of that property, and in any case does not include any other component to a level greater than 3 mass %.

The term "or" is intended to encompass both exclusive and inclusive cases, i.e., "A or B" is intended to be synonymous with "at least one of A and B," unless otherwise expressly specified herein.

The indefinite articles "a" and "an" refer to both singular forms (i.e., "one") and plural referents (i.e., one or more) unless the context clearly dictates otherwise. Thus, embodiments using "an antioxidant" include embodiments where one, two, or more antioxidants are used, unless specified to the contrary or the context clearly indicates that only one antioxidant is used.

The term "mass %" means percentage by mass such as percentage by weight, "vol %" means percentage by volume, "mol %" means percentage by mole, "ppm" means parts per million, and "ppm wt" and "wppm" are used interchangeably and mean parts per million on a weight basis. All concentrations herein, unless otherwise stated, are expressed on the basis of the total amount of the composition in question.

The term "polymer" refers to any two or more of the same or different repeating units/mer units or units. The term "homopolymer" refers to a polymer having units that are the same. The term "copolymer" refers to a polymer having two or more units that are different from each other and includes terpolymers and the like. The term "terpolymer" refers to a polymer having three units that are different from each other. The term "different" as it refers to units indicates that the units differ from each other by at least one atom or are different isomerically. Likewise, the definition of polymer, as used herein, includes homopolymers, copolymers, and the like.

The term "oil base stock" refers to any base fluid that could be used in a lubricant such as a mineral oil, a synthetic hydrocarbon, and an ester, including Group I, II, III, IV, and V base oils. The terms "base oil", "oil base stock", and "basestock" are used interchangeably.

The term "alphaolefin" refers to any linear or branched compound of carbon and hydrogen having at least one double bond between the a and R carbon atoms. For purposes of this specification and the claims appended thereto, when a polymer or copolymer is referred to as including an alpha-olefin, e.g., polyalphaolefin, the alpha-olefin present in such polymer or copolymer is the polymerized form of the alpha-olefin.

Nomenclature of elements and groups thereof used herein are pursuant to the Periodic Table used by the International Union of Pure and Applied Chemistry after 1988. An example of the Periodic Table is shown in the inner page of the front cover of Advanced Inorganic Chemistry 6th Edition, by F. Albert Cotton et a. (John Wiley & Sons, Inc., 1999).

A detailed description will now be provided. Each of the appended claims defines a separate invention, which for infringement purposes is recognized as including equivalents to the various elements or limitations specified in the claims. Depending on the context, all references to the "invention" may in some cases refer to certain specific embodiments only. In other cases, it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this disclosure is combined with publicly available information and technology.

Lubricant Composition

A sulfur-free, ashless, low phosphorus-containing lubricant composition is disclosed that can include about 60.0 to about 99.8 mass %, preferably about 70.0 to about 95.0 mass %, and more preferably about 80.0 to about 90.0 mass %, of an oil base stock containing at least one polyalphaolefin and at least one alkyl naphthalene. The lubricant composition also can include at least one ashless antiwear additive, at least one ashless detergent, and at least one antioxidant. The term "sulfur-free" means that the lubricant composition has less than about 0.05 mass %, preferably less than about 0.03 mass %, and more preferably less than about 0.01 mass %, of sulfur. The term "ashless" means that the lubricant composition has less than about 0.05 mass %, preferably less than about 0.03 mass %, and more preferably less than about 0.01 mass %, of metal material. The term "low phosphorus-containing" means that the lubricant composition less than about 0.05 mass %, preferably less than about 0.03 mass %, and more preferably less than about 0.01 mass %, of phosphorus. All of the foregoing mass percentages are based on the total mass of the lubricant composition.

The lubricant composition can be used as an engine oil. The use of a sulfur-free, ashless, and low-phosphorus-containing engine oil advantageously minimizes the adverse effects the oil could otherwise have on post-treatment devices such as particulate filters and the catalysts associated therewith. Accordingly, the longevity of post-treatment devices can be improved by using the lubricant composition disclosed herein.

The lubricant composition also unexpectedly exhibits improved oxidation stability at high temperatures. The oxidation stability of the lubricant composition can be demonstrated by the composition having a high onset oxidation temperature of about 250° C. to about 350° C., preferably about 250° C. to about 270° C., and more preferably about 255 C to about 265° C., as measured according to ASTM E2009-08 Test Method B with some minor adjustments (see the Examples). The improved oxidation stability of the lubricant composition can be further demonstrated by the composition taking longer than expected to reach a 200% viscosity increase. In particular, the lubricant composition can have a 200% viscosity increase time at 165° C. of about 400 hours to about 1,500 hours, more preferably about 950 hours to about 1,300 hours, as measured by the Sequence IIIE screener test (see the Examples). Since the lubricant composition is more stable at high temperatures, less cooling of the engine is needed, allowing for increased efficiency of the engine. For example, the lubricant composition is stable at oil sump temperatures of about 130° C. or higher, preferably 150° C. or higher, and more preferably 160° C. or higher.

In one or more embodiments, the lubricant composition can include about 20.0 to about 90.0 mass %, preferably about 40.0 to about 80.0 mass %, more preferably about 50.0 to about 70.0 mass %, and even more preferably about 65.0 mass % of the polyalphaolefin. The lubricant composition can further include about 5.0 to about 80.0 mass %, preferably about 10.0 to about 40.0 mass %, more preferably about 20.0 to about 30.0 mass %, and even more preferably about 20.0 mass % of the at least one alkyl naphthalene. The lubricant composition can also include about 0.10 to about 1.00 mass %, preferably about 0.15 to about 0.70 mass %, and more preferably about 0.20 to about 0.50 mass %, of at least one ashless antiwear additive. The lubricant composition can also include about 0.5 to about 2.0 mass %, preferably about 0.7 to about 1.5 mass %, and more preferably about 0.8 to about 1.2 mass %, of at least one ashless detergent based on the total mass of the lubricant oil composition. Additionally, the lubricant composition can include about 0.5 to about 3.0 mass %, preferably about 0.5 to about 1.0 mass %, of at least one antioxidant. All of the foregoing mass percentages are based on the total mass of the lubricant composition.

The lubricant composition can be made by mixing together the various components disclosed above while heating the components using any method known in the art. For example, the various components could be added to a vessel maintained at a temperature of about 60° C. to about 90° C., preferably about 70° C. to about 85° C., followed by mixing the components together with a stirrer.

Oil Base Stock

The oil base stock can be or can include at least one polyalphaolefin (PAO) and at least one alkyl naphthalene. The PAO can include one or more Group IV base oils, as defined by the American Petroleum Institute (API Publication 1509; www.API.org). Group IV base oils are synthetic polymerized olefins.

The number average molecular weight of the PAOs, which are known materials and generally available on a major commercial scale from suppliers such as ExxonMobil Chemical Company, Chevron Phillips Chemical Company, BP, and others, can vary from about 250 to about 3,000. PAOs can be made in viscosities up to about 150 cSt (100° C.). The PAOs are typically comprised of relatively low molecular weight hydrogenated polymers or oligomers of alphaolefins, including $C_2$ to about $C_{32}$ alphaolefins with the $C_8$ to about $C_{16}$ alphaolefins, such as 1-hexene, 1-octene, 1-decene, 1-dodecene and the like, being preferred. Preferred PAOs are poly-1-hexene, poly-1-octene, poly-1-decene and poly-1-dodecene and mixtures thereof, and mixed olefin-derived polyolefins. However, the dimers of higher olefins in the range of $C_{14}$ to $C_{18}$ can be used to provide low viscosity base stocks of acceptably low volatility. Depending on the viscosity grade and the starting oligomer, the PAOs can be predominantly trimers and tetramers of the starting olefins, with minor amounts of the higher oligomers, having a viscosity range of 1.5 to 12 cSt. PAO fluids of particular use can have viscosities of, e.g., 3.0 cSt, 3.4 cSt, and/or 3.6 cSt. Bi-modal mixtures of PAO fluids having a viscosity range of 1.5 to 150 cSt also can be used if desired.

PAOs can be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

PAOs can be conveniently made by the polymerization of an alphaolefin in the presence of a polymerization catalyst such as a Lewis acid catalyst, e.g. $BF_3$ or $ACl_3$, or a Friedel-Crafts catalyst, e.g., aluminum trichloride, boron trifluoride or complexes of boron trifluoride with water, alcohols such as ethanol, propanol or butanol, and carboxylic acids or esters such as ethyl acetate or ethyl propionate. Suitable methods for making PAOs are disclosed in U.S. Pat. Nos. 4,149,178 and 3,382,291, the relevant portions thereof being incorporated by reference herein in their entirety. Other descriptions of PAO synthesis can be found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of $C_{14}$ to $C_{18}$ olefins are described in U.S. Pat. No. 4,218,330.

Alternatively or additionally, the catalyst system can be or can include one or more non-metallocene Ziegler-Natta catalysts. Alternatively or additionally, the catalyst system can include a metal oxide supported on an inert material, e.g., chromium oxide supported on silica. Such catalyst systems and uses thereof in the process for making PAOs are disclosed in, e.g., U.S. Pat. No. 4,827,073 (Wu); 4,827,064 (Wu); 4,967,032 (Ho et al.); 4,926,004 (Pelrine et al.); and 4,914,254 (Pelrine), the relevant portions thereof being incorporated by reference herein in their entirety.

The catalyst system can alternatively or additionally include one or more metallocene catalysts. Metallocene-catalyzed PAO (mPAO) can be a homopolymer made from a single alphaolefin feed or can be a copolymer made from two or more different alphaolefins, each by employing a suitable metallocene catalyst system. Suitable metallocene catalysts can be or can include one or more simple metallocenes, substituted metallocenes, or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anions, mPAO and methods for producing mPAO employing metallocene catalysis are described in WO 2007/011832 and U.S. patent application 2009/0036725, the relevant portions thereof being incorporated by reference herein in their entirety.

Homopolymer mPAO compositions can be made from single alphaolefins chosen from alphaolefins in the $C_2$ to $C_{30}$ range, preferably $C_2$ to $C_{16}$, most preferably $C_3$ to $C_{14}$ or $C_3$ to $C_{12}$. The homopolymers can be isotactic, atactic, syndiotactic, or of any other appropriate tacticity. The tacticity can be tailored by the choices of polymerization catalyst, polymerization reaction conditions, hydrogenation conditions, or combinations thereof.

Copolymer mPAO compositions can be made from at least two alphaolefins of $C_2$ to $C_{30}$ range, and typically have monomers randomly distributed in the finished copolymers. It is preferred that the average carbon number is at least 4.1. Advantageously, ethylene and propylene, if present in the feed, can be present in the amount of less than 50 mass % individually or preferably less than 50 mass % combined. The copolymers can be isotactic, atactic, syndiotactic or of any other appropriate tacticity.

Copolymer mPAO compositions can also be made from mixed feed linear alpha olefins (LAOs) having from two to 26 different linear alphaolefins selected from $C_2$ to $C_{30}$ linear alphaolefins. Such mixed feed LAO can be obtained from an ethylene growth process using an aluminum catalyst or a metallocene catalyst. The growth olefins can be mostly $C_6$ to $C_{18}$ LAO. LAOs from other processes can also be used.

Useful alphaolefins can be obtained from a conventional LAO production facility, from a refinery, from a chemical plant, and even from Fischer-Tropsch synthesis processes (as reported in U.S. Pat. No. 5,382,739). Alphaolefins include propylene, 1-butene, 1-pentene, 1-hexene, 1-octene, other $C_2$ to $C_{16}$ alphaolefins, $C_{16+}$ alphaolefins, LAOs, and the like. For example, when used alone, $C_2$ to $C_{16}$ alphaolefins, more preferably linear alphaolefins, are suitable to make homopolymers. Other combinations of alphaolefin plus LAO, such as for example, $C_4$ and $C_{14}$-LAO, $C_6$- and $C_{16}$-LAO, $C_8$-, $C_{10}$-, $C_{12}$-LAO, or $C_8$- and $C_{14}$-LAO. $C_6$-, $C_{10}$-, $C_{14}$-LAO, $C_4$, and $C_{12}$-LAO, etc., are suitable to make copolymers.

A feed comprising a mixture of LAOs selected from $C_2$ to $C_{30}$ LAOs or a single LAO selected from $C_2$ to $C_{16}$ LAO, can be contacted with an activated metallocene catalyst under oligomerization conditions to provide a liquid product suitable for use as a component in adhesive formulations. Copolymer compositions made from two or more alphaolefins of $C_2$ to $C_{30}$ range, with monomers randomly incorporated into the copolymer, can also be used as a component in adhesive formulations. Other suitable PAOs are described in, for example, U.S. Patent Application No. 2013/0005633.

The alkylated naphthalene present in the oil base stock can be any hydrocarbyl molecule that contains at least about 5% of its mass derived from a naphthenoid moiety or its derivatives. Suitable alkylated naphthalenes can include alkyl naphthalenes, alkyl naphthols, and the like. The naphthenoid group can be mono-alkylated, dialkylated, polyalkylated, and the like. The naphthenoid group can be mono- or poly-functionalized. The naphthenoid group can also be derived from natural (petroleum) sources, provided at least about 5% of the molecule is comprised of the naphthenoid moiety. Viscosities at 100° C. of approximately 3 cSt to about 50 cSt are preferred, with viscosities of approximately 3.4 cSt to about 20 cSt often being more preferred for the naphthylene component. In one embodiment, an alkyl naphthalene where the alkyl group is primarily comprised of 1-hexadecene is used. Other alkylates of naphthalene can be used if desired. Naphthalene or methyl naphthalene, for example, can be alkylated with olefins such as octene, decene, dodecene, tetradecene or higher, mixtures of similar olefins, and the like.

Alkylated naphthalenes can be produced by well-known Friedel-Crafts alkylation of aromatic compounds. See Friedel-Crafts and Related Reactions, Olah, G. A. (ed.), Interscience Publishers, New York, 1963. For example, an aromatic compound, such as naphthalene, is alkylated by an olefin, alkyl halide, or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous solid catalysts are known in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Ashless Antiwear Additive

The ashless antiwear additive can serve to reduce wear between engine parts. The antiwear additive can be or can include an amine phosphate, an over-neutralized amine phosphate, or combinations thereof. The amine phosphate can be prepared by reacting an amine compound or a polyamine compound with a phosphoric acid. Suitable amines are disclosed in U.S. Pat. No. 4,234,435, the relevant portions thereof being incorporated by reference herein. An "over-neutralized" amine phosphate is preferred, meaning that a more than sufficient amount of amine is added to neutralize an acid phosphate, and this neutralization can be done with one or more amines.

The phosphorus compounds disclosed herein can be prepared by wellknown reactions. For example, they can be prepared by the reaction of an alcohol or a phenol with phosphorus trichloride or by a transesterification reaction. C6 to C12 alcohols and alkyl phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. In any case, the reaction can be conducted with moderate heating. Moreover, various phosphorus esters can be prepared by reaction using other phosphorus esters as starting materials. Thus, medium chain (C6 to C22) phosphorus esters can be prepared by reaction of dimethylphosphite with a mixture of medium-chain alcohols by means of a thermal transesterification or an acid- or base-catalyzed transesterification; see for example U.S. Pat. No. 4,652,416. Such materials are also commercially available: for instance, triphenyl phosphite is available from Albright and Wilson as Duraphos TPP™; di-n-butyl hydrogen phosphite is available from Albright and Wilson as Duraphos DBHP™; and triphenylthiophosphate is available from BASF as Irgalube TPPT™.

An alkyl or aryl phosphoric acid and a dialkyl or diaryl phosphoric acid, or their mixtures, can be neutralized by one or more amines. Amines that can form amine salts with such phosphoric acids include, for example, mono-substituted amines, di-substituted amines and tri-substituted amines. Examples of mono-substituted amines include butylamine, pentylamine, hexylamine, cyclohexylamine, octylamine, laurylamine, stearylamine, oleylamine and benzylamine. Examples of di-substituted amines include dibutylamine, dipentylamine, dihexylamine, dicyclohexylamine, dioctylamine, dilaurylamine, ditridecylamine, distearylamine, dioleylamine, dibenzylamine, stearyl monoethanolamine, decyl monoethanolamine, hexyl monopropanolamine, benzyl monoethanolamine, phenyl monoethanolamine, and tolyl monopropanolamine. Examples of tri-substituted amines include tibutylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine, and tripropanolamine.

Polyamines that can form salts with the phosphoric acids provided herein include, for example, alkoxylated diamines, fatty polyamine diamines, alkylenepolyamines, hydroxy containing polyamines, condensed polyamines arylpolyamines, and heterocyclic polyamines. Examples of fatty diamines include mono- or dialkyl, symmetrical or asymmetrical ethylene diamines, propane diamines (1,2, or 1,3), and polyamine analogs of the above. Suitable commercial fatty polyamines are Duomeen C. (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co. of Chicago, Ill.

Examples of alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylenediamine, triethylenetetramine, tris-(2-aminoethyl)amine, propylenediamine, trimethylenediamine, tripropylenetetramine, tetraethylenepentamine, hexaethylenheptamine, pentaethylenehexamine, etc. Higher homologs obtained by condensing two or more of the above-noted alkyleneamines are similarly useful as are mixtures of two or more of the aforedescribed polyamines. Ethylenepolyamine are described in detail under the heading Ethylene Amines in Kirk Othmer's "Encyclopedia of Chemical Technology", 2d Edition, Vol. 7, pages 22-37, Interscience Publishers, New York (1965). Ethylenepolyamines are often a complex mixture of polyalkylenepolyamines, including cyclic condensation products.

Other useful types of polyamine mixtures are those resulting from stripping of mixtures of the above-described polyamines to leave, as residue, what is often termed "polyamine bottoms". In general, alkylenepolyamine bottoms can be characterized as having less than 2 mass %, usually less than 1 mass %, of material boiling below about 200° C. A typical sample of such ethylene polyamine bottoms obtained from the Dow Chemical Company of Freeport, Tex. is designated "E-100". These alkylenepolyamine bottoms include cyclic condensation products such as piperazine and higher analogs of diethylenetriamine, triethylenetetramine, and the like. The alkylenepolyamine bottoms can be reacted solely with the acylating agent or they can be used with other amines, polyamines, or mixtures thereof. Another useful polyamine is a condensation reaction between at least one hydroxy compound with at least one polyamine reactant containing at least one primary or secondary amino group. The hydroxy compounds are preferably polyhydric amines. Polyhydric amines can include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl) amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris(hydroxymethyl)aminomethane (THAM). Other heterocyclic amines can also include aromatic polycyclic amines. Examples of aromatic polycyclic amines include tolytriazole and benzotriazole.

The amines mentioned above can be used as a neutralization agent for the alkyl or aryl phosphoric acid, dialkyl or diaryl phosphoric acid, or their mixtures as well as an over-neutralization agent to obtain an overbased alkyl or aryl phosphate, or a dialkyl or diary phosphate, or their mixtures. The preferred amine phosphate is a dialkylphosphoric acid, first neutralized with a dialkyl amine, and then over-neutralized with a tolytriazole. More preferably, the dialkylphosphoric acid is a dihexylphosporic acid.

The other phosphates that could be used as ashless antiwear include triaryl phosphates, trialkyl phosphates, trialkylaryl phosphates, triarylalkyl phosphates and trialkenyl phosphates. As specific examples of these, referred to are triphenyl phosphate, tricresl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutyphenylphenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate, and trioleyl phosphate.

Ashless Detergent

The ashless detergent can serve to maintain engine cleanliness, and to inhibit the contaminants from being deposited on engine parts. The ashless detergent can be or can include a nonionic detergent such as polyoxyethylene, polyoxypropylene, and polyoxybutylene alkyl ethers. For reference, see "Nonionic Surfactants: Physical Chemistry" Martin J. Schick, CRC Press $2^{nd}$ edition (Mar. 27, 1987). These ashless detergents are less common in engine lubricant formulations but offer a number of advantages such as improved solubility in ester base oils.

The most preferred detergents are ashless nonionic detergents with a Hydrophilic-Lipophilic Balance (HLB) value of 10 or below. Such detergents are commercially available from, e.g., Croda Inc. under the tradename Alarmol™ PS11E and Alarmol™ PS15E and from the Dow Chemical Co. under the tradename Ecosurf™ EH-3, Tergitol™ 15-S-3, Tergitol™ L-61, Tergitol™ L-62, Tergitol™ NP-4, Tergitol™ NP-6, Tergitol™ NP-7, Tergitol™ NP-8, Tergitol™ NP-9, Triton™ X-15, and Triton™ X-35.

The detergent concentrations disclosed herein are given on an "as delivered" basis. Typically, the active detergent is delivered with a process oil. The "as delivered" detergent can include from about 20 mass % to about 100 mass %, preferably from about 40 mass % to about 60 mass %, of active detergent in the"as delivered" detergent product.

Dispersants

The lubricant composition can also include one or more dispersants. During engine operation, oil-insoluble oxidation byproducts can be produced. Dispersants can help keep these byproducts in solution, thus diminishing their deposition on metal surfaces. Dispersants used in the formulation of the lubricating composition can be ashless or ash-forming in nature. Preferably, the dispersant is ashless, meaning that it is an organic material that forms substantially no ash upon combustion. For example, non-metal-containing or borated metal-free dispersants are considered ashless. In contrast, metal-containing detergents discussed above form ash upon combustion.

Such dispersants can be present in the lubricant composition in an amount of about 0.1 to about 20.0 mass %, preferably about 0.5 to about 8.0 mass %, or more preferably about 0.5 to 4.0 mass %, based on a total weight of the lubricant composition. The hydrocarbon numbers of the dispersant atoms can range from C60 to C1000, or from C70 to C300, or from C70 to C200. These dispersants may contain both neutral and basic nitrogen or mixtures of both. The dispersants can be end-capped by borates and/or cyclic carbonates.

Suitable dispersants can contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil is normally a polyisobutylene group. Many examples of this type of dispersant are well known commercially and in the literature. See, for example, U.S. Pat. Nos. 3,172,892; 3,215,707; 3,219,666; 3,316,177; 3,341,542; 3,444,170; 3,454,607; 3,541,012; 3,630,904; 3,632,511; 3,787,374; and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; and 5,705,458. A further description of dispersants can be found, for example, in European Patent Application No. 471 071.

Hydrocarbyl-substituted succinic acid and hydrocarbyl-substituted succinic anhydride derivatives also can be used as dispersants. In particular, succinimide, succinate esters, or succinate ester amides prepared by the reaction of a hydrocarbon-substituted succinic acid compound, preferably having at least 50 carbon atoms in the hydrocarbon substituent, with at least one equivalent of an alkylene amine, are particularly useful. On occasion, having a hydrocarbon substituent having 20 to 50 carbon atoms can be useful.

Succinimides can be formed by the condensation reaction between hydrocarbyl substituted succinic anhydrides and amines. Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; 3,652,616; and 3,948,800; and in Canada Patent No. 1,094,044.

Succinate esters can be formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides can be formed by a condensation reaction between hydrocarbyl substituted succinic anhydrides and alkanol amines. Suitable alkanol amines include ethoxylated polyalkylpolyamines, propoxylated polyalkylpolyamines, and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides typically ranges between 800 and 2,500 or more. The above products can be post-reacted with various reagents such as sulfur, oxygen, formaldehyde, and carboxylic acids such as oleic acid. The above products can also be post reacted with boron compounds such as boric acid, borate esters, and highly borated dispersants, to form borated dispersants generally having from 0.1 to 5.0 moles of boron per mole of dispersant reaction product.

Mannich based dispersants can also be used and are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols can range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products can be prepared from high molecular weight alkyl-substituted hydroxyaromatics or $HNR_2$ group-containing reactants.

Hydrocarbyl substituted amine ashless dispersant additives are well known to those skilled in the art. See, for example, U.S. Pat. Nos. 3,275,554; 3,438,757; 3,565,804; 3,755,433; 3,822,209; and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5,000, or from 1,000 to 3,000, or from 1,000 to 2,000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Polymethacrylate or polyacrylate derivatives are another class of dispersants. These dispersants are typically prepared by reacting a nitrogen containing monomer and a methacrylic or acrylic acid ester containing 5 to 25 carbon atoms in the ester group. Representative examples are shown in U.S. Pat. Nos. 2,100,993 and 6,323,164. Polymethacrylate and polyacrylate dispersants are normally used as multifunctional viscosity index improvers. The lower molecular weight versions can be used as lubricant dispersants or fuel detergents.

The use of polymethacrylate or polyacrylate dispersants are preferred in polar esters of a non-aromatic dicarboxylic acid, preferably adipate esters, since many other conventional dispersants are less soluble. The preferred dispersants for polyol esters include polymethacrylate and polyacrylate dispersants.

Viscosity Index Improver

One or more viscosity index improvers (also known as VI improvers, viscosity modifiers, and viscosity improvers) can be included in the lubricant composition. Viscosity index improvers can serve to provide lubricants with high and low temperature operability. These additives impart shear stability at elevated temperatures and acceptable viscosity at low temperatures. The viscosity index improver can be present the lubricant composition in an amount of about 1.0 to about 20.0 mass %, preferably about 5.0 to about 15.0 mass %, and more preferably about 8.0 to about 12.0 mass %, based on the total weight of the lubricant composition.

Suitable viscosity index improvers include high molecular weight hydrocarbons, polyesters, and viscosity index improver dispersants that function as both a viscosity index improver and a dispersant. Typical molecular weights of these polymers are between about 10,000 to 1,500,000, more typically about 20,000 to about 1,200,000, and even more typically about 50,000 to about 1,000,000. The typical molecular weight for polymethacrylate or polyacrylate viscosity index improvers is less than about 50,000.

Examples of suitable viscosity index improvers are linear or star-shaped polymers and copolymers of methacrylate, butadiene, olefins, or alkylated styrenes. Polyisobutylene is a commonly used viscosity index improver. Another suitable viscosity index improver is polymethacrylate (e.g., copolymers of various chain length alkyl methacrylates), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers having a molecular weight of about 50,000 to 200,000.

Suitable olefin copolymers are commercially available from: Chevron Oronite Company LLC under the tradename PARATONE® (such as PARATONEX® 8921 and PARATONE® 8941); Afton Chemical Corporation under the tradename HiTEC® (such as HiTEC® 5850B; and The Lubrizol Corporation under the tradename Lubrizol® 7067C. Hydrogenated polyisoprene star polymers are commercially available from Infineum International Limited. e.g., under the tradename SV200 and SV600. Hydrogenated diene-styrene block copolymers are commercially available from Infineum International Limited, e.g., under the tradename SV 50.

As used herein, the viscosity index improver concentrations are given on an "as delivered" basis. Typically, the active polymer is delivered with a diluent oil. The "as delivered" viscosity index improver typically contains from about 20 to about 75 mass % of an active polymer for polymethacrylate or polyacrylate polymers, or from about 8 to about 20 mass % of an active polymer for olefin copolymers, hydrogenated polyisoprene star polymers, or hydrogenated diene-styrene block copolymers, in the "as delivered" polymer concentrate.

Antioxidant

The antioxidant can serve to retard the oxidative degradation of the oil base stock. Such degradation could result in deposits on metal surfaces, the presence of sludge, or a viscosity increase in the lubricant composition. The antioxidant can be or can include a phenolic antioxidant, an aminic antioxidant, a polyaminic antioxidant, or combinations thereof.

The phenolic antioxidant is typically a hindered phenolic which contains a sterically hindered hydroxyl group, including those derivatives of dihydroxy aryl compounds in which the hydroxyl groups are in the o- or p-position to each other. Suitable hindered phenols can include hindered phenols substituted with $C_{6+}$ alkyl groups and the alkylene coupled derivatives of those hindered phenols such as 2-t-butyl-4-heptyl phenol, 2-t-butyl-4-octyl phenol, 2-t-butyl-4-dodecyl phenol, 2,6-di-t-butyl-4-heptyl phenol, 2,6-di-t-butyl-4-dodecyl phenol, 2-methyl-6-t-butyl-4-heptyl phenol, and 2-methyl-6-t-butyl-4-dodecyl phenol. Other useful hindered mono-phenolic antioxidants can include, e.g., hindered 2,6-di-alkyl-phenolic proprionic ester derivatives. Bis-phenolic antioxidants can also be advantageously used in combination with the hindered phenolic antioxidants. Suitable ortho-coupled phenols can include: 2,2'-bis(4-heptyl-6-t-butyl-phenol); 2,2'-bis(4-octyl-6-t-butyl-phenol); and 2,2'-bis(4-dodecyl-6-t-butyl-phenol). Suitable para-coupled bisphenols can include: 4,4'-bis(2,6-di-t-butyl phenol); and 4,4'-methylene-bis(2,6-di-t-butyl phenol).

The aminic antioxidant is typically an aromatic amine antioxidant. Suitable amine antioxidants can include alkylated and non-alkylated aromatic amines such as aromatic monoamines of the formula $R^8R^9R^{10}N$, where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$, where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ can include from 1 to 20 carbon atoms and preferably include from 6 to 12 carbon atoms. Preferably, both $R^8$ and $R^9$ are aromatic or substituted aromatic groups, where the aromatic group can be a fused ring aromatic group such as naphthyl.

Suitable aromatic amine antioxidants can have alkyl substituent groups of at least 6 carbon atoms. Examples of aliphatic groups can include hexyl, heptyl, octyl, nonyl, and decyl. Typically, the aliphatic groups do not contain more than 14 carbon atoms. The general types of amine antioxidants useful in the lubricant composition disclosed herein include diphenylamines, phenyl naphthylamines, phenothiazines, imidodibenzyls and diphenyl phenylene diamines. Mixtures of two or more aromatic amines can be used. Particular examples of suitable aromatic amine antioxidants include: p,p'-dioctyldiphenylamine; t-octylphenyl-alpha-naphthylamine; phenyl-alpha-naphthylamine; and p-octylphenyl-alpha-naphthylamine. Polymeric aminic antioxidants derived from these diphenylamines, phenyl naphthylamines, and their mixtures can also be used. The polymeric aminic antioxidants can be available in a concentrate form with active polymeric amines in the 10 to 40 mass %. Such polymeric aminic antioxidant concentrates are commercially available from, e.g., Nyco S.A. under the tradename Nycoperf AO 337.

Other suitable aminic antioxidants include polymeric or oligomeric amines which are the polymerization reaction products of one or more substituted or hydrocarbyl-substituted diphenyl amines, one or more unsubstituted or hydrocarbyl-substituted phenyl naphthyl amines, or both one or more of unsubstituted or hydrocarbyl-substituted diphenylamine with one or more unsubstituted or hydrocarbyl-substituted phenyl naphthylamine. A representative schematic is presented below:

(a)

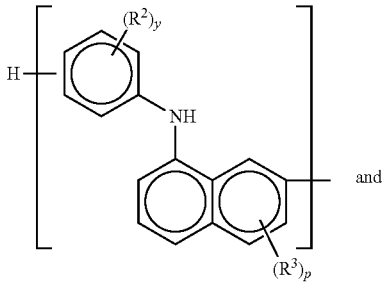

and (b)

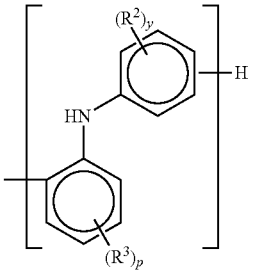

wherein (a) and (b) each range from zero to 10, preferably zero to 5, more preferably zero to 3, most preferably 1 to 3, provided (a)+(b) is at least 2, for example:

(A)

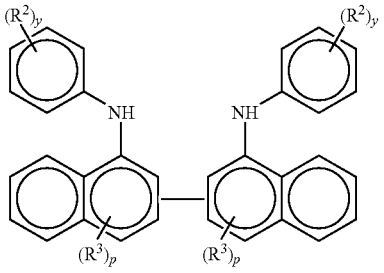

or

-continued (B)

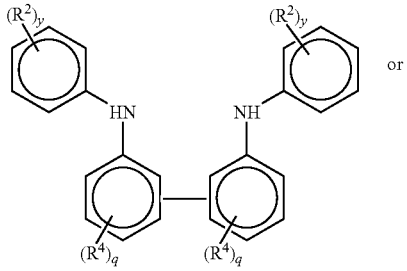

or (C)

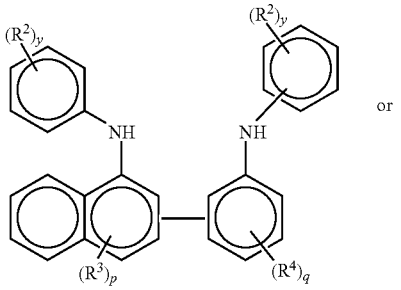

or (D)

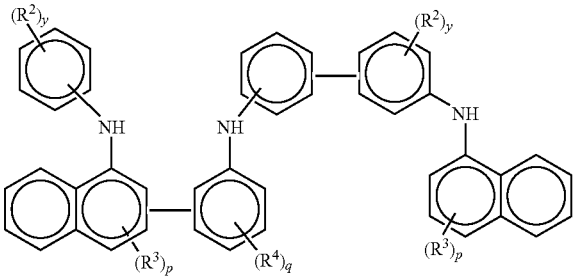

where $R^2$ is a styrene or $C_1$ to $C_{30}$ alkyl, $R^3$ is a styrene or $C_1$ to $C_{30}$ alkyl, $R^4$ is a styrene or $C_1$ to $C_{30}$ alkyl, preferably $R_2$ is a $C_1$ to $C_{30}$ alkyl, $R_3$ is a $C_1$ to $C_{30}$ alkyl, $R_4$ is a $C_1$ to $C_{30}$ alkyl, more preferably $R_2$ is a $C_4$ to $C_{10}$ alkyl, $R_3$ is a $C_4$ to $C_{10}$ alkyl and $R_4$ is a $C_4$ to $C_{10}$ alkyl, p, q and y individually range from 0 to up to the valence of the aryl group to which the respective R group(s) are attached, preferably at least one of p, q and y range from 1 to up to the valence of the aryl group to which the respective R group(s) are attached, more preferably p, q and y each individually range from at least 1 to up to the valence of the aryl group to which the respective R groups are attached. Other more extensive oligomers are within the scope of this disclosure, but materials of formulae A, B, C and D are preferred. Examples can also be found in U.S. Pat. No. 8,492,321.

Other Additives

The lubricant composition can additionally include other lubricant performance additives known in the art such as corrosion inhibitors, rust inhibitors, metal deactivators, extreme pressure additives, anti-seizure agents, wax modifiers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973), see also U.S. Pat. No. 7,704,930, which is incorporated by reference herein in its entirety. These additives are commonly delivered with varying amounts of diluent oil that may range from 5 to 50 mass %. When lubricating oil compositions include one or more of the foregoing additives, the additive(s) can be blended into the composition in an amount sufficient for it to perform its intended function.

EXAMPLES

The foregoing discussion can be further described with reference to the following non-limiting examples.

Six lubricant formulations (Ex. 1-6) were made that contained alkylated naphthalene and PAO as the base oil, an ashless nonionic detergent, an ashless amine phosphate antiwear additive, and a phenolic antioxidant combined with one or more aminic antioxidants or a polymerized amine antioxidant. The specific mass % of each component in Ex. 1-6 are provided below in Table 1, where all mass percentages are based on the total mass of the lubricant formulation (less any diluent).

A comparative lubricant formulation (C. Ex. 2) was also prepared that contained PAO as the base oil, an ashless nonionic detergent, an ashless amine phosphate antiwear additive, and a phenolic antioxidant combined with an aminic antioxidant.

A comparative lubricant formulation (C. Ex. 3) was also prepared that contained alkylated naphthalene as the base oil, an ashless nonionic detergent, an ashless amine phosphate antiwear additive, and a phenolic antioxidant combined with an aminic antioxidant. The specific mass % of each component in C. Ex. 2-3 are provided in Table 2 below, where all mass percentages are based on the total mass of the lubricant formulation.

The alkylated naphthalene used in Ex. 1-6 and C. Ex. 3 was Synnestic™ 5, which is commercially available from ExxonMobil Chemical Company of Houston, Tex. The PAO used in Ex. 1-6 and C. Ex. 2 was Spectrasyn™ 6 which is commercially available from ExxonMobil Chemical Company of Houston, Tex. Each formulation was made by adding each component of the formulation to a beaker heated to a temperature of 70° C. to 85° C. followed by blending the components together with a stirrer.

TABLE 1

Formulations and Properties of Examples 1-6

| | Ex. 1 | Ex. 2 | Ex. 3 | Ex. 4 | Ex. 5 | Ex. 6 |
|---|---|---|---|---|---|---|
| Synnestic ™ 5 (alkylated naphthalene) mass % | 5.00 | 10.00 | 20.00 | 45.63 | 60.00 | 39.58 |
| SpectraSyn ™ 6 (PAO) mass % | 79.63 | 74.63 | 64.63 | 39.00 | 24.63 | 36.00 |
| Phenolic antioxidant mass % | 1.00 | 1.00 | 1.00 | 1.00 | 1.00 | 1.00 |

TABLE 1-continued

| Formulations and Properties of Examples 1-6 | | | | | | |
|---|---|---|---|---|---|---|
| | Ex. 1 | Ex. 2 | Ex. 3 | Ex. 4 | Ex. 5 | Ex. 6 |
| p,p'-dioctyldiphenylamine antioxidant mass % | 0.95 | 0.95 | 0.95 | 0.95 | 0.95 | |
| Octylated phenyl-alpha-naphthylamine antioxidant mass % | 0.95 | 0.95 | 0.95 | 0.95 | 0.95 | 0.95 |
| Polymerized amine antioxidant concentrate mass % | | | | | | 10.00 |
| Nonionic detergent mass % | 0.95 | 0.95 | 0.95 | 0.95 | 0.95 | 0.95 |
| Amine phosphate antiwear additive mass % | 0.25 | 0.25 | 0.25 | 0.25 | 0.25 | 0.75 |
| Other additive mixture mass % | 11.27 | 11.27 | 11.27 | 11.27 | 11.27 | 11.27 |
| ASTM D4591, Calcium mass % | <0.001 | <0.001 | <0.001 | <0.001 | <0.001 | <0.001 |
| ASTM D4591, Molybdenum mass % | <0.001 | <0.001 | <0.001 | <0.001 | <0.001 | <0.001 |
| ASTM D4591, Phosphorus mass % | 0.008 | 0.008 | 0.008 | 0.008 | 0.008 | 0.008 |
| ASTM D4591, Zinc mass % | <0.001 | <0.001 | <0.001 | <0.001 | <0.001 | <0.001 |
| Calculated, Sulfur mass % | 0.000 | 0.000 | 0.000 | 0.000 | 0.000 | 0.000 |
| HPDSC, Onset temperature, ° C. | 249 | 258 | 258 | 259 | 258 | 261 |
| Sequence IIIE Screener (165° C.), Hours to 200% viscosity increase | 552 | 730 | 1280 | 977 | 966 | 979 |

TABLE 2

| Formulations and Properties of Comparative Examples 1-3 | | | |
|---|---|---|---|
| | C.Ex.1 | C.Ex.2 | C.Ex.3 |
| Synnestic ™ 5 (alkylated naphthalene) mass % | | | 84.63 |
| SpectraSyn ™ 6 (PAO) mass % | | 84.63 | |
| Phenolic antioxidant mass % | | 1.00 | 1.00 |
| p,p'-dioctyldiphenylamine antioxidant mass % | | 0.95 | 0.95 |
| Octylated phenyl-alpha-naphthylamine antioxidant mass % | | 0.95 | 0.95 |
| Polymerized amine antioxidant concentrate mass % | | | |
| Nonionic detergent mass % | | 0.95 | 0.95 |
| Amine phosphate antiwear additive mass % | | 0.25 | 0.25 |
| Other additive mixture mass % | | 11.27 | 11.27 |
| ASTM D4591, Calcium mass % | 0.331 | <0.001 | <0.001 |
| ASTM D4591, Molybdenum mass % | 0.008 | <0.001 | <0.001 |
| ASTM D4591, Phosphorus mass % | 0.101 | 0.008 | 0.008 |
| ASTM D4591, Zinc mass % | 0.107 | <0.001 | <0.001 |
| ASTM D6443, Sulfur mass % | 0.231 | | |
| Calculated, Sulfur mass % | | 0.000 | 0.000 |
| HPDSC, Onset temperature, °C. | | 258 | 266 |
| Sequence IIIE Screener (165° C.), Hours to 200% viscosity increase | 322 | 428 | 667 |

The foregoing formulations were tested to determine various properties thereof, as shown in Tables 1 and 2 above. As depicted in Table 2, a conventional synthetic engine oil (C. Ex. 1) containing a conventional viscosity index improver, dispersant, detergent, antioxidant, pour point depressant, antifoam additive, etc. was tested as the other formulations. The calcium mass % was found to be less than 0.001 for the formulations in Ex. 1-6 and C. Ex. 2-3 using ASTM D4591, whereas the calcium mass % was found to be higher (0.331) for the synthetic engine oil in C. Ex. 1. The molybdenum mass % was found to be less than 0.001 for the formulations in Ex. 1-6 and C. Ex. 2-3 using ASTM D4591, whereas the molybdenum mass % was found to be higher (0.008) for the synthetic engine oil in C. Ex. 1. The zinc mass % was found to be less than 0.001 for the formulations in Ex. 1-6 and C. Ex. 2-3 using ASTM D4591, whereas the zinc mass % was found to be higher (0.107) for the synthetic engine oil in C. Ex. 1. The phosphorus mass % was found to 0.008 for the formulations in Ex. 1-6 and C. Ex. 2-3 using ASTM D4591, whereas the phosphorus mass % was found to be higher (0.101) for the synthetic engine oil in C. Ex. 1. The sulfur mass % was calculated as being 0.000 in Ex. 1-6 and C. Ex. 2-3, whereas it was found to be higher (0.231) for the synthetic engine oil in C. Ex. 1 using ASTM D6443.

All the formulations in Ex. 1-6 and C. Ex. 1-3 were subjected to a High Pressure Differential Scanning Calorimetry (HPDSC) test in which the oxidation onset temperature was measured with a Universal V4.5A TA instrument equipped with a Q20 Tzero Pressure DSC Cell. The test method was similar to ASTM E2009-08 Test Method B except that 500 psig of air was used instead of 500 psig of oxygen and the sample size was 3.0+/−0.2 mg. The pressurized sample was first equilibrated at 50° C. and then ramped up to 400° C. at 10° C./min. As shown in Tables 1 and 2, the oxidation onset temperatures of the lubricant formulations in Ex. 1-6 were 249° C. or higher, reaching as high as 261° C. in Ex. 6, which was different from the other examples in that it included a polymerized aminic antioxidant.

All the formulations of Ex. 1-6 and C. Ex. 1-3 were subjected to a bench oxidation test (Sequence IIIE screener) that was conducted at 165° C., under a flow of 500 mL/min of air, with 40 ppm of iron from ferric acetylacetonate, which was added as a catalyst. Oil samples were taken periodically, and their viscosities at 40° C. were measured using a Houillon viscometer. The time (hours) to reach 200% viscosity increase was recorded for each example. As shown in The FIGURE, the 200% viscosity increase time was surprisingly much higher for the formulations of Ex. 3-5 (containing both PAO and alkylated naphthalene in the oil base stock) than that of the formulations of C. Ex. 2 (containing only PAO) and C. Ex. 3 (containing only alkylated naphthalene) while it was somewhat higher for the formulation of Ex. 2. Without intending to be limited by theory, the combination of the PAO and alkylated naphthalene as the oil base appears to have a synergistic effect on the time to reach 200% viscosity increase when the mass % of the alkylated naphthalene is at least 10.00 mass %, as in Ex. 2-6. However, the formulation of Ex. 1 had a lower 200% viscosity increase time than that of C. Ex. 3, probably because it contained only 5.00 mass % alkylated naphthalene. The 200% viscosity increase time was also much higher for the formulations of Ex. 1-6 and C. Ex. 2-3 than for the conventional formulation in C. Ex. 1, as shown in Table 2 above.

Listing of Embodiments

This disclosure may further include any one or more of the following non-limiting embodiments:

1. A lubricant composition for use as an engine oil, comprising: about 60.0 mass % to about 99.8 mass % of an oil base stock, based on a total mass of the lubricant composition, the oil base stock comprising at least one polyalphaolefin and at least one alkyl naphthalene; at least one ashless antiwear additive; at least one ashless detergent; and at least one antioxidant, wherein the lubricant composition comprises less than about 0.05 mass % phosphorus, less than about 0.05 mass % sulfur, and less than about 0.05 mass % ash.

2. The lubricant composition of embodiment 1, wherein the lubricant composition comprises about 20.0 mass % to about 90.0 mass % of the at least one polyalphaolefin, based on the total mass of the lubricant composition.

3. The lubricant composition of embodiment 1 or 2, wherein the lubricant composition comprises about 5.0 mass % to about 80.0 mass % of the at least one alkyl naphthalene, based on the total mass of the lubricant composition.

4. The lubricant composition of embodiments 1 to 3, wherein the lubricant composition comprises about 0.1 mass % to about 1.0 mass % of the at least one ashless antiwear additive, based on the total mass of the lubricant composition.

5. The lubricant composition of embodiments 1 to 4, wherein the lubricant composition comprises about 0.5 mass % to about 2.0 mass % of the at least one ashless detergent, based on the total mass of the lubricant composition.

6. The lubricant composition of embodiments 1 to 5, wherein the lubricant composition comprises about 0.5 mass % to about 3.0 mass % of the at least one antioxidant, based on the total mass of the lubricant composition.

7. The lubricant composition of embodiments 1 to 6, wherein the at least one ashless antiwear additive comprises an amine phosphate.

8. The lubricant composition of embodiments 1 to 7, wherein the at least one antioxidant comprises a phenolic antioxidant, an aminic antioxidant, a polyaminic antioxidant, or combinations thereof.

9. The lubricant composition of embodiments 1 to 8, further comprising an onset oxidation temperature of about 200° C. to about 350° C.

10. The lubricant composition of embodiments 1 to 9, further comprising an onset oxidation temperature of about 250° C. to about 270° C.

11. The lubricant composition of embodiments 1 to 10, further comprising a 200% viscosity increase time at 165° C. of about 400 hours to about 1,500 hours, as measured by the Sequence IIIE screener test.

12. The lubricant composition of embodiments 1 to 11, further comprising a 200% viscosity increase time at 165° C. of about 950 hours to about 1,300 hours, as measured by the Sequence IIIE screener test.

13. The lubricant composition of embodiments 1 to 12, wherein the lubricant composition comprises about 70.0 mass % to about 95.0 mass % of the oil base stock based on the total mass of the lubricant composition 14. The lubricant composition of embodiments 1 to 13, wherein the lubricant composition comprises 80.0 mass % to about 90.0 mass % of the oil base stock based on the total mass of the lubricant composition 15. The lubricant composition of embodiments 1 to 14, wherein the lubricant composition comprises: about 40.0 mass % to about 80.0 mass % of the at least one polyalphaolefin; about 10.0 mass % to about 40.0 mass % of the at least one alkyl naphthalene; about 0.15 mass % to about 0.70 mass % of the at least one ashless antiwear additive; about 0.7 mass % to about 1.5 mass % of the at least one ashless detergent; and about 0.5 mass % to about 1.0 mass % of the at least one antioxidant, wherein all mass percentages are based on the total mass of the lubricant composition.

16. The lubricant composition of embodiments 1 to 15, wherein the lubricant composition comprises: about 50.0 mass % to about 70.0 mass % of the at least one polyalphaolefin; about 20.0 mass % to about 30.0 mass % of the at least one alkyl naphthalene; about 0.2 mass % to about 0.5 mass % of the at least one ashless antiwear additive; about 0.8 mass % to about 1.2 mass % of the at least one ashless detergent; and about 0.5 mass % to about 1.0 mass % of the at least one antioxidant, wherein all mass percentages are based on the total mass of the lubricant composition.

17. The lubricant composition of embodiments 1 to 16, wherein the lubricant composition comprises less than about 0.03 mass % phosphorus, less than about 0.03 mass % sulfur, and less than about 0.03 mass % ash.

18. The lubricant composition of embodiments 1 to 17, wherein the lubricant composition comprises less than about 0.01 mass % phosphorus, less than about 0.01 mass % sulfur, and less than about 0.01 mass % ash.

19. A process for making a lubricant composition, comprising: combining about 60.0 mass % to about 99.8 mass % of an oil base stock, the oil base stock comprising about 20.0 mass % to about 90.0 mass % of at least one polyalphaolefin and about 5.0 mass % to about 80.0 mass % of at least one alkyl naphthalene; about 0.1 mass % to about 1.0 mass % of at least one ashless antiwear additive; about 0.5 mass % to about 2.0 mass % of at least one ashless detergent; and about 0.5 mass % to about 3.0 mass % of at least one antioxidant, to provide a lubricant composition, wherein the lubricant composition comprises less than about 0.05 mass % phosphorus, less than about 0.05 mass % sulfur, and less than about 0.05 mass % ash, wherein all mass percentages are based on a total mass of the lubricant composition.

20. The process of embodiment 19, wherein the lubricant composition comprises less than about 0.03 mass % phosphorus, less than about 0.03 mass % sulfur, and less than about 0.03 mass % ash.

21. The process of embodiment 19 or 20, wherein the lubricant composition comprises less than about 0.01 mass % phosphorus, less than about 0.01 mass % sulfur, and less than about 0.01 mass % ash.

22. The process of embodiments 19 to 21, wherein the at least one ashless antiwear additive comprises an amine phosphate.

23. The process of embodiments 19 to 22, wherein the at least one antioxidant comprises a phenolic antioxidant, aminic antioxidant, polyaminic antioxidant, or combinations thereof.

24. The process of embodiments 19 to 23, wherein said combining comprises mixing together about 40.0 mass % to about 80.0 mass % of the at least one polyalphaolefin; about 10.0 mass % to about 40.0 mass % of the at least one alkyl naphthalene; about 0.15 mass % to about 0.70 mass % of the at least one ashless antiwear additive; about 0.7 mass % to about 1.5 mass % of the at least one ashless detergent; and about 0.5 mass % to about 1.0 mass % of the at least one antioxidant, wherein all mass percentages are based on the total mass of the lubricant composition.

Certain embodiments and features have been described using a set of numerical upper limits and a set of numerical lower limits. It should be appreciated that ranges including the combination of any two values, e.g. the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A lubricant composition for use as an engine oil, comprising:

about 60.0 mass % to about 99.8 mass % of an oil base stock, based on a total mass of the lubricant composition, the oil base stock comprising at least one polyalphaolefin and at least one alkyl naphthalene;

at least one ashless antiwear additive;

at least one ashless detergent; and at least one antioxidant, wherein the lubricant composition comprises less than about 0.05 mass % phosphorus, less than about 0.05 mass % sulfur, and less than about 0.05 mass % ash.

2. The lubricant composition of claim 1, wherein the lubricant composition comprises about 20.0 mass % to about 90.0 mass % of the at least one polyalphaolefin, based on the total mass of the lubricant composition.

3. The lubricant composition of claim 1, wherein the lubricant composition comprises about 5.0 mass % to about 80.0 mass % of the at least one alkyl naphthalene, based on the total mass of the lubricant composition.

4. The lubricant composition of claim 1, wherein the lubricant composition comprises about 0.1 mass % to about 1.0 mass % of the at least one ash less antiwear additive, based on the total mass of the lubricant composition.

5. The lubricant composition of claim 1, wherein the lubricant composition comprises about 0.5 mass % to about 2.0 mass % of the at least one ashless detergent, based on the total mass of the lubricant composition.

6. The lubricant composition of claim 1, wherein the lubricant composition comprises about 0.5 mass % to about 3.0 mass % of the at least one antioxidant, based on the total mass of the lubricant composition.

7. The lubricant composition of claim 1, wherein the at least one ashless antiwear additive comprises an amine phosphate.

8. The lubricant composition of claim 1, wherein the at least one antioxidant comprises a phenolic antioxidant, an aminic antioxidant, a polyaminic antioxidant, or combinations thereof.

9. The lubricant composition of claim 1, further comprising an onset oxidation temperature of about 200° C. to about 350° C.

10. The lubricant composition of claim 1, further comprising an onset oxidation temperature of about 250° C. to about 270° C.

11. The lubricant composition of claim 1, further comprising a 200% viscosity increase time at 165° C. of about 400 hours to about 1,500 hours, as measured by the Sequence IIIE screener test.

12. The lubricant composition of claim 1, further comprising a 200% viscosity increase time at 165° C. of about 950 hours to about 1,300 hours, as measured by the Sequence IIIE screener test.

13. The lubricant composition of claim 1, wherein the lubricant composition comprises about 70.0 mass % to about 95.0 mass % of the oil base stock based on the total mass of the lubricant composition.

14. The lubricant composition of claim 1, wherein the lubricant composition comprises 80.0 mass % to about 90.0 mass % of the oil base stock based on the total mass of the lubricant composition.

15. The lubricant composition of claim 1, wherein the lubricant composition comprises:

about 40.0 mass % to about 80.0 mass % of the at least one polyalphaolefin;

about 10.0 mass % to about 40.0 mass % of the at least one alkyl naphthalene;

about 0.15 mass % to about 0.70 mass % of the at least one ashless antiwear additive;

about 0.7 mass % to about 1.5 mass % of the at least one ashless detergent; and about 0.5 mass % to about 1.0 mass % of the at least one antioxidant, wherein all mass percentages are based on the total mass of the lubricant composition.

16. The lubricant composition of claim 1, wherein the lubricant composition composes:

about 50.0 mass % to about 70.0 mass % of the at least one polyalphaolefin;

about 20.0 mass % to about 30.0 mass % of the at least one alkyl naphthalene;

about 0.2 mass % to about 0.5 mass % of the at least one ashless antiwear additive;

about 0.8 mass % to about 1.2 mass % of the at least one ashless detergent; and about 0.5 mass % to about 1.0 mass % of the at least one antioxidant, wherein all mass percentages are based on the total mass of the lubricant composition.

17. The lubricant composition of claim 1, wherein the lubricant composition comprises less than about 0.03 mass % phosphorus, less than about 0.03 mass % sulfur, and less than about 0.03 mass % ash.

18. The lubricant composition of claim 1, wherein the lubricant composition comprises less than about 0.01 mass % phosphorus, less than about 0.01 mass % sulfur, and less than about 0.01 mass % ash.

19. A process for making a lubricant composition, comprising:

combining about 60.0 mass % to about 99.8 mass % of an oil base stock, the oil base stock comprising about 40.0 mass % to about 80.0 mass % of at least one polyalphaolefin and about 10.0 mass % to about 40.0 mass % of at least one alkyl naphthalene; about 0.1 mass % to about 1.0 mass % of at least one ashless antiwear additive; about 0.5 mass % to about 2.0 mass % of at least one ashless detergent; and about 0.5 mass % to about 3.0 mass % of at least one antioxidant, to provide a lubricant composition, wherein the lubricant composition comprises less than about 0.05 mass % phosphorus, less than about 0.05 mass % sulfur, and less than about 0.05 mass % ash, wherein all mass percentages are based on a total mass of the lubricant composition.

20. The process of claim 19, wherein the lubricant composition comprises less than about 0.03 mass % phosphorus, less than about 0.03 mass % sulfur, and less than about 0.03 mass % ash.

21. The process of claim 19, wherein the lubricant composition comprises less than about 0.01 mass % phosphorus, less than about 0.01 mass % sulfur, and less than about 0.01 mass % ash.

22. The process of claim 19, wherein the at least one ashless antiwear additive comprises an amine phosphate.

23. The process of claim 19, wherein the at least one antioxidant comprises a phenolic antioxidant, aminic antioxidant, polyaminic antioxidant, or combinations thereof.

24. The process of claim 19, wherein said combining comprises mixing together about 40.0 mass % to about 80.0 mass % of the at least one polyalphaolefin;

about 10.0 mass % to about 40.0 mass % of the at least one alkyl naphthalene;

about 0.15 mass % to about 0.70 mass % of the at least one ashless antiwear additive;

about 0.7 mass % to about 1.5 mass % of the at least one ashless detergent; and about 0.5 mass % to about 1.0 mass % of the at least one antioxidant, wherein all mass percentages are based on the total mass of the lubricant composition.

* * * * *